United States Patent [19]

Blain et al.

[11] Patent Number: 5,069,684

[45] Date of Patent: Dec. 3, 1991

[54] FUEL AND LUBE ADDITIVES FROM POLYETHER DERIVATIVES OF POLYAMINE ALKENYL SUCCINIMIDES

[75] Inventors: David A. Blain, Mt. Laurel; Angeline B. Cardis, Florence, both of N.J.

[73] Assignee: Mobil Oil Corporation, Fairfax, Va.

[21] Appl. No.: 452,074

[22] Filed: Dec. 18, 1989

[51] Int. Cl.[5] ..... C10L 1/22

[52] U.S. Cl. ..... 44/331; 548/520

[58] Field of Search ..... 44/331; 548/520

[56] References Cited

U.S. PATENT DOCUMENTS

| | | | |
|---|---|---|---|
| 3,051,562 | 8/1962 | Gee et al. | 44/331 |
| 3,287,271 | 11/1966 | Stuart et al. | 548/520 |
| 3,374,174 | 3/1968 | LeSuer | 548/520 |
| 3,676,089 | 7/1972 | Morris et al. . | |
| 3,843,535 | 10/1974 | Denis et al. | 252/57 |
| 3,857,865 | 12/1974 | Sturwold et al. | 252/57 |
| 3,905,781 | 9/1975 | Dorn . | |
| 3,980,448 | 9/1976 | Haemnerle et al. . | |
| 4,094,802 | 6/1978 | Soula et al. . | |
| 4,127,492 | 11/1978 | Fossati et al. | 548/520 |
| 4,326,987 | 4/1982 | Hendricks et al. . | |
| 4,482,464 | 11/1984 | Karol et al. . | |
| 4,521,318 | 6/1985 | Karol . | |
| 4,617,138 | 12/1986 | Wollenberg | 252/51.5 A |
| 4,684,473 | 8/1987 | Bock et al. | 252/57 |
| 4,713,187 | 12/1987 | Buckley et al. . | |
| 4,737,159 | 4/1988 | Phillips . | |
| 4,780,111 | 10/1988 | Dorer et al. | 44/331 |
| 4,783,275 | 11/1988 | Wollenberg . | |
| 4,790,957 | 12/1988 | Mack et al. | 252/57 |
| 4,802,893 | 2/1989 | Wollenberg et al. . | |

*Primary Examiner*—Prince Willis, Jr.
*Assistant Examiner*—Jerry D. Johnson
*Attorney, Agent, or Firm*—Alexander J. McKillop; Charles J. Speciale; L. G. Wise

[57] ABSTRACT

The present invention discloses superior fuel and lubricant additives prepared by the acylation of alkyl or alkenyl succinimides with the polyether half-esters of dicarboxylic acids. The polyether half-esters of dicarboxylic acids are grafted onto the polyamine moiety of alkyl or alkenyl succinimides by reacting the succinimide and the half-ester of the dicarboxylic acid under amidation conditions to form an amide group with an amino group of the polyamine. The process is carried out by first reacting a monofunctional polyalkylene ether with a dicarboxylic acid to produce a half-ester of the dicarboxylic acid. This product is then reacted with an alkyl or alkenyl succinimide polyamine ashless dispersant to product a multifunctional hydrocarbon fuel or lubricant additive that exhibits augmented dispersant properties.

15 Claims, No Drawings

FUEL AND LUBE ADDITIVES FROM POLYETHER DERIVATIVES OF POLYAMINE ALKENYL SUCCINIMIDES

This invention relates to novel fuel and lubricant additives, methods for their preparation and to fuel and lubricant mixtures containing these additives. More particularly, the invention relates to additives prepared by the acylation of alkyl or alkenyl succinimides with the polyether half-esters of dicarboxylic acids. These additives are useful, inter alia, as antioxidants, dispersants, corrosion inhibitors and antiwear agents

BACKGROUND OF THE INVENTION

The formulation of hydrocarbon fuels and lubricants typically includes additives comprising a variety of chemicals to improve properties in application specific situations, particularly gasoline and diesel internal combustion engines. The more commonly used additives include oxidation inhibitors, rust inhibitors, metal passivators, antiwear agents, extreme pressure additives, pour point depressants, detergent-dispersants, lube viscosity index (VI) improvers, foam inhibitors and the like. The scope of the operating conditions to which internal combustion engines are subjected can readily result in lubricant degradation, leading to sludge buildup and excessive engine wear. The foregoing additives serve to control this and other problems in various ways. In the lubricant arts, this aspect is specifically described in Kirk-Othmer "Encyclopedia of Chemical Technology", 3rd edition, Vol. 14, pp 477–526, incorporated herein by reference.

It is known that alkenyl succinimides (ASI) prepared from alkenyl succinic anhydrides (ASA) and polyalkyleneamines are effective as additives to provide ashless dispersancy. These are typically prepared from materials such as polyisobutenyl succinic anhydride and tetraethylene penatamine. Examples of such succinimides are described in U.S. Pat. Nos. 3,024,237, 3,172,892, 3,202,678, 3,219,666 and 3,257,554. The succinimides may comprise mono or bis succinimides prepared according to the following general reaction:

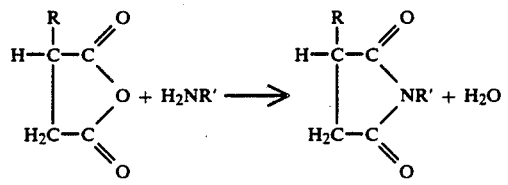

where R is an alkyl or alkenyl of from 8 to 10,000 carbon atoms and R' is the remainder of the polyamine moiety. The term succinimide as used herein includes mono, bis and polysuccinimides as determined by the functionality of the polyamine and molar ratio of reactants.

It is also known that further derivation of alkyl or alkenyl succinimides can be accomplished to enhance the dispersant properties of these succinimides or to augment these properties with additional functions, such as improved antioxidant properties and the like, thereby providing multifunctional additives.

In U.S. Pat. No. 4,482,464 to Karol et al, the reaction product between a polyamine bis-alkenyl succinimide (ASI) and a hydroxy carboxylic acid such as glycolic or 2, 2'- bis hydroxy methyl propionic acid is disclosed.

The process comprises coupling with a glycolic acid to form an amido group with the amine of the polyamine. The patent neither discloses nor claims aromatic acids or polyether derivatives thereof.

U.S. Pat. No. 4,713,187 to Buckley et al discloses a bis-ASI polyamine wherein the amine is acylated with oxyl containing a polyether chain and further combined with boric acid or derivative thereof. The patent differs from the present invention in one part in that an oxalic rather than phthalic acid polyether derivative is used.

U.S. Pat. No. 4,783,275 to Wollenberg discloses lubricant additives comprising polyamino ASI modified by treatment with a lactone to yield polyamino ASI wherein one or more of the basic nitrogens of the polyamino moiety is substituted with a hydrocarbylcarbonyl alkylene group. Wollenberg further discloses in U.S. Pat. No. 4,802,893 additives comprising polyamino ASI wherein one or more of the polyamino nitrogens is substituted with hydrocarbyl oxycarbonyl, hydroxy hydrocarbyl oxycarbonyl, or hydroxy poly (oxyalkylene) oxycarbonyl. The invention also discloses and claims the boron product of the adducted ASI. The invention does not teach phthaloyl adducts or phthaloyl adducts containing polyethers.

It is an object of the present invention to provide novel, multifunctional fuel and lubricant additives comprising dicarboxylic acid esters of polyethers and alkenyl or alkyl succinimides.

It is another object of the instant invention to provide a method for producing the foregoing novel, multifunctional additives.

Yet another object of the instant invention is to provide fuel additives having superior dispersant properties.

A further object of the invention is to provide novel fuel and lubricant compositions incorporating the additives of the present invention.

SUMMARY OF THE INVENTION

In the present invention it has been discovered that superior fuel and lubricant additives are prepared by the acylation of alkyl or alkenyl succinimides with the polyether half-esters of dicarboxylic acids. The polyether half-esters of dicarboxylic acids are grafted onto the polyamine moiety of alkyl or alkenyl succinimides by reacting the ASI and the half-ester of the dicarboxylic acid under amidation conditions to form an amide group with an amino group of the polyamine. The overall process is carried out by first reacting a monofunctional polyalkylene ether with a dicarboxylic acid in a manner so as to produce a half-ester of the dicarboxylic acid. This intermediate carboxylic acid reaction product is then reacted with an alkyl or alkenyl succinimide ashless dispersant prepared from an alkyl or alkenyl succinic acid or anhydride and a polyamine by known methods. The novel composition so produced comprises a multifunctional hydrocarbon fuel or lubricant additive that exhibits augmented dispersant properties by virtue of the polyether carboxylic ester moiety and the ashless dispersant qualities of the succinimide moiety.

More particularly, the invention comprises a fluid lubricant or fuel additive composition containing an amount sufficient of a compound of the following structure to provide dispersant or detergent properties thereto:

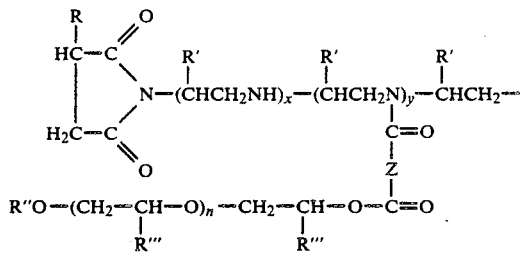

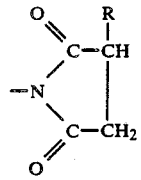

wherein x, y and n are integers, y is at least 1, x+y is from 1 to 10, and n is from 1 to 100; and where R is an alkyl or alkenyl group containing from 8 to about 10,000 carbon atoms, R' is H or $C_1$ to $C_6$ alkyl, R'' is an alkyl, aryl, alkaryl, or arylalkyl containing 1 to 100 carbon atoms, R''' is hydrogen or an alkyl, aryl, alkaryl, or arylalkyl containing 1 to 100 carbon atoms; and wherein Z is the arylidene, alkylidene, arylalkylidene or alkylarylidene moiety of a dicarboxylic acid.

The liquid lubricant or fuel additive composition of the invention comprises the reaction product from the amidation reaction between:

a) the monocarboxylic acid residue from the reaction, under esterification conditions, of about equimolar equivalents of a dicarboxylic acid, or derivative thereof, and a monohydroxy polyalkylene ether; and b) the succinimide reaction product from the reaction of about one molar equivalent of an alkyl or alkenyl succinic acid, or derivative thereof, and about one-half molar equivalent of a polyalkylene amine having the formula $NH_2(CHRCH_2NH)_xH$, where x is an integer from 2 to 10 and R is hydrogen or $C_1$ to $C_6$ alkyl.

DETAILED DESCRIPTION OF THE INVENTION

In the present invention, dicarboxylic acids, acid anhydrides or other derivatives are reacted with mono hydroxyl functional polyethers to produce a reaction product containing the half-ester and some diester of the dicarboxylic acid. This reaction product is then reacted with a polyamino alkyl or alkenyl succinimide to produce the product of the invention. The monofunctional polyethers used in the present invention contain one free hydroxyl group per polyether molecule to form the half-ester reaction product. The overall reaction is shown below using phthalic anhydride as a non-limiting example of a dicarboxylic acid derivative useful in the invention:

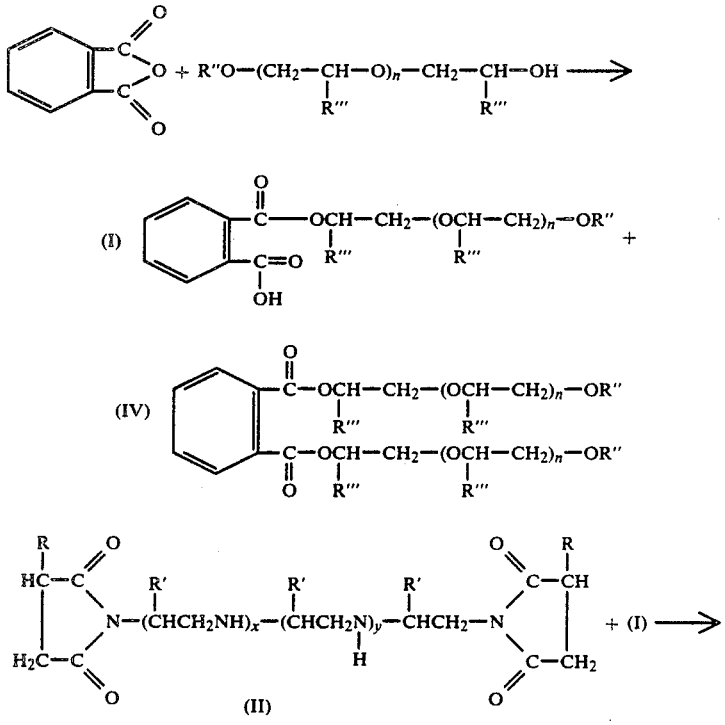

-continued

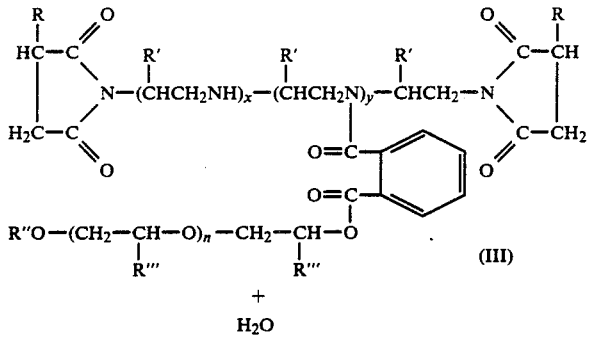

(III)

In the foregoing examples (I) through (IV), x and y are integers, y is at least 1, x+y is from 1 to 10. R is an alkyl or alkenyl group containing from 8 to about 10,000 carbon atoms, and R' is H or $C_1$ to $C_6$ alkyl. R'' is an alkyl, aryl, alkaryl, or arylalkyl containing 1 to 100 carbon atoms and R''' is hydrogen or an alkyl, aryl, alkaryl, or arylalkyl containing 1 to 100 carbon atoms.

The intermediate (I) in the preceeding example comprises poly(oxyalkylene)alkyl hydrogen phthalate where the alkylene moiety is preferably ethylene, propylene or isobutylene. Some diester (IV) is formed which carries over as a reaction product of the invention.

The products of the reaction of the invention are represented more generally by the structural formulae (V) and (VI) presented below where R, R', R'' and R''' are as described for (I) through (IV) above and Z is the arylidene, alkylidene, arylalkylidene or alkylarylidene moiety of a dicarboxylic acid containing at least three carbon atoms:

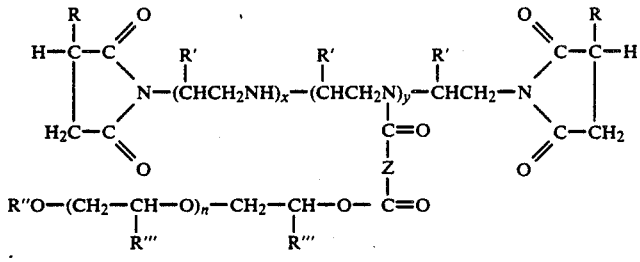

(V)

and

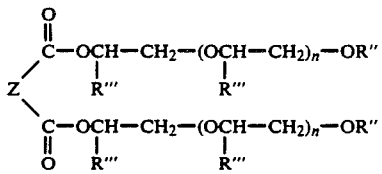

(VI)

The reaction of a polyamine with alkenyl or alkyl succinic anhydride to produce the polyamino alkenyl or alkyl succinimides (II) employed in the present invention is well known in the art and is disclosed in U.S. Pat. Nos. 2,992,708; 3,018,291; 3,024,237; 3,100,673; 3,219,666; 3,172,892, and 3,272,746. These patents are incorporated herein by reference for their disclosures on preparing alkenyl or alkyl succinimides.

The preparation of the alkenyl-substituted succinic anhydride by reaction with a polyolefin and maleic anhydride has been described, e.g., U.S. Pat. Nos. 3,018,250 and 3,024,195. The methods include the thermal reaction of the polyolefin with maleic anhydride. Reduction of the alkenyl-substituted succinic anhydride yields the corresponding alkyl derivative.

The polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins. The polyolefin polymer usually contains from about 8 to 10,000 carbon atoms, although preferably 20 to 300 carbon atoms. A preferred class of olefin polymers comprises the polybutenes, which are prepared by polymerization of one or more of 1-butene, 2-butene. Polymers of isobutene are particularly preferred. Usually, isobutene units constitute at least 80% of the units in the polymer. Methods for the preparation of these materials are found in U.S. Pat. Nos. 3,215,707; 3,231,587; 3,515,669; and 3,579,450, as well as U.S. Pat. No. 3,912,764.

Polyamines, or polyalkylenepolyamines, used to prepare the foregoing succinimides (II) have the formula $H_2N(C_mH_{2m}NH)_xH$, where m is from 2 to 6 and x is from 1 to 10. Preferred polyamines include the ethylene polyamine (m=2), where x is 1 (ethylenediamine), x is 2 (diethylenetriamine), x is 3 (triethylenetetramine), x is 4 (tetraethylenepentamine), and the like.

The polyamine employed to prepare the polyamino alkenyl or alkyl succinimides used in the process of this invention is preferably a polyamine having from 2 to about 12 amine nitrogen atoms. The polyamine is reacted with an alkenyl or alkyl succinic anhydride to produce the polyamino alkenyl or alkyl succinimide, employed in this invention. The polyamine is so selected so as to provide at least one basic amine per succinimide.

In many instances the polyamine used as a reactant in the production of succinimides of the present invention is not a single compound but a mixture of several amines. For example, tetraethylene pentamine prepared by the polymerization of aziridine will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Methods of preparation of polyamines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

The dicarboxylic acids or acid anhydrides employed in the present invention include preferably phthalic acid, isophthalic acid, terephthalic acid, the isomers of naphthalene dicarboxylic acid, malonic acid, maleic acid, succinic acid, glutaric acid, fumaric acid, adipic acid, pimelic acid, suberic acid, azelaic acid, sebacic acid and the like. However, aromatic or aliphatic dicarboxylic acids containing from three to twenty carbon atoms can be used. These acids may contain substituent groups such as halogen, hydroxyl, alkoxy, aryloxy, alkyl or aryl to provide useful dicarboxylic acids such as tartronic acid, phenyl malonic acid, chlorophthalic acid and the like. Dicarboxylic acid anhydrides are prefered in the present invention. Particularly useful carboxylic acid anhydrides include orthophthalic anhydride, 1,8-naphthalic anhydride, succinic anhydride and maleic anhydride.

In the process of the invention the dicarboxyic acids can be reacted with the mono-functional polyether to form a half-ester or a derivative of the dicarboxylic acid may be so employed. While useful derivatives include preferably dicarboxylic acid anhydrides, acyl halides may be used as well. The acylation of alcohols by acyl halides is a process well known in synthetic organic chemistry and can be employed without substantive modification to prepare halfesters of dicarboxylic acids as prepared in the present invention without departing from the intent or scope of the invention. Mono esters of dicarboxylic acids derived from lower alcohols, such as methanol or ethanol, can also be used in the process whereby the reaction with the mono-functional polyether proceeds by way of transesterification by methods well known in the organic chemical arts.

The alcohols employed in the invention in the reaction with dicarboxylic acids to prepare (I) are monohydroxy polyalkylene ethers have the formula $$R''O(CH_2\underset{R'''}{\underset{/}{C}}HO)_nCH_2\underset{R'''}{\underset{/}{C}}HOH,$$

where n is an integer from 1 to 100, R'' is an aromatic or aliphatic hydrocarbon having from 1 to 100 carbon atoms, and R''' is hydrogen or an aromatic or aliphatic hydrocarbon having from 1 to 100 carbon atoms. These mono-functional, or capped or mono-hydroxy alcohols, are commercially available or may be prepared by known processes as described in Kirk-Othmer's Encyclopedia of Chemical Technology, Vol. 19, p 507. They are generally prepared by the addition of a lower alkylene oxide such as ethylene oxide or propylene oxide to an alcohol, typically an aliphatic primary alcohol. They may be prepared as homo or copolymers and typically contain molecules of various molecular weight.

The following examples serve to illustrate the process of the present invention to prepare the novel fuel and lubricant additives.

EXAMPLE 1

Phthalic anhydride (1.0 mole, 148.1 g), mono-capped polybutylene oxide (1.0 mole, 487 g), p-toluenesulfonic acid (0.05 mole, 9.5 g) and 500 ml of xylenes are charged to a 2 L 4-necked reactor equipped with an overhead stirrer, thermometer, Dean Stark trap, and $N_2$ purge. The reaction mixture is heated to reflux and was kept at this temperature (150° C.) for six hours. During this time, 6.0 ml of water collects in the Dean Stark trap. Upon cooling, a small amount of phthalic anhydride precipitated out of solution. This is filtered off through a pad of celite. The resulting clear solution is stripped using rotary evaporation, (0.5 mm Hg). Upon cooling, another small portion of phthalic anhydride precipitates out. This is again removed by suction filtration through a pad of celite. The resulting clear, brown liquid is titrated withn 0.1N KOH and is found to have a combining weight of 1098, where combining weight is: sample Wt.(gms)$\times$10,000/ml 0.1N KOH, and indicates the molecular weight associated with each carbonyl group. Only a trace of unreacted anhydride is evident by IR spectroscopy. Infrared analysis indicates the reaction product comprises polybutylene oxide hydrogen phthalate containing some dipolybutylene oxide phthalate.

EXAMPLE 2

The product from, Example 1 (0.03 mole, 33.2 g), a polyisobutenyl succinimide (0.03 mole, 87.8 g, made by reacting 920 MW polyisobutylene and maleic anhydride, followed by one half equivalent of tetraethylene pentamine), and 100 ml xylenes are charged to a 500 ml 4-necked round bottom flask equipped withn an overhead stirrer, thermometer, Dean Stark trap, and $N_2$ purge. The reaction is heated to reflux and is refluxed for seventeen hours. During this time most of the solvent evaporates. The resulting product is filtered through a bed of celite. Amide, ester, and succinimide bands are detected by IR spectroscopy.

The method of this invention is preferably carried out as exemplified in Example 2 wherein the half-ester reaction product and succinimide are reacted in a mole ratio of about 1:1, where the half-ester molecular weight is estimated by determination of the combining weight with 0.1N KOH. However, the rection ratios of the esterification reation product to ASI can increase up to 10:1, particularly when polyamines containing multiple secondary amine groups are used to prepare the ASI for reaction with the esterification reaction product.

The detergency properties of the products of the invention were evaluated in the following test. The results indicated the superior performance of the product.

EXAMPLE 3

$C_2$-Evalutation

The product from Example 2 is evaluated by the CRC Carburetor Cleanliness procedure at a dosage of 100 lb/MB in Phillips J unleaded fuel.

| Additive | Deposit Wt. (mg) | % Clean-up |
|---|---|---|
| None | 16 | — |
| Example 2 | 3 | 81 |

The acylated succinimides of the instant invention are particularly useful as detergent and dispersant additives to fuels and lubricants. These novel succinimides may be added to mineral oil based lubricants or to synthetic lubricants. In either case, other additives typically found in lubricants such as viscosity index improvers, rust inhibitors, pour point depressants, antioxidants and other additives well known in the art may be incorporated into the formulation.

The products of this invention can be added to a fuel at about 25 lbs to about 500 lbs of additive per 1000 barrels of fuel. It can be added to a lubricant at about 0.1% to about 10% by weight.

While the invention has been described by specific examples and embodiments, there is no intent to limit the inventive concept except as set forth in the following claims.

What is claimed is:

1. A fuel composition containing a base fuel medium and an amount sufficient of an additive compound of the following structure to provide dispersant or detergent properties thereto:

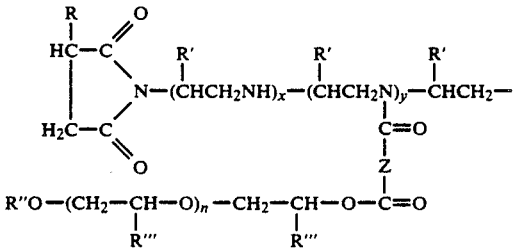

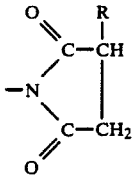

wherein x, y and n are integers, y is at least 1, x+y is from 1 to 10, and n is from 1 to 100; and were R is an alkyl or alkenyl group containing from 8 to about 10,000 carbon atoms, R′ is H or $C_1$ to $C_6$ alkyl, R″ is an alkyl, aryl, alkylaryl, or arylalkyl containing 1 to 100 carbon atoms, R‴ is hydrogen or an alkyl, aryl, alkaryl, or arylalkyl containing 1 to 100 carbon atoms; and wherein Z is the arylidene or alkylarylidene moiety of a dicarboxylic acid.

2. The composition of claim 1 wherein y is from 2 to 10.

3. The composition of claim 1 where R‴ comprises $C_1$ to $C_{12}$ alkyl groups.

4. The composition of claim 1 wherein R‴ comprises phenyl groups containing $C_1$ to $C_{12}$ alkyl substituent groups.

5. The composition of claim 1 where R″ comprises $C_1$ to $C_{12}$ alkyl groups.

6. The composition of claim 1 wherein R″ comprises phenyl groups containing $C_1$ to $C_{12}$ alkyl substituent groups.

7. The composition of claim 1 wherein Z comprises phenylene, alkylphenylene, naphthylidene or alkylnaphthylidene.

8. A fuel additive composition comprising the reaction product from the amidation reaction between:

a) the monocarboxylic acid residue from the reaction, under esterification conditions, of about equimolar equivalents of an aromatic dicarboxylic acid or anhydride and a monohydroxy polyalkylene ether; and b) the succinimide reaction product from the reaction of about one molar equivalent of an alkyl or alkenyl succinic acid, or derivative thereof, and about one-half molar equivalent of a polyalkylene amine having the formula $NH_2(CHRCH_2NH)_xH$, where x is an integer from 2 to 10 and R is hydrogen or $C_1$ to $C_6$ alkyl.

9. The composition of claim 8 wherein said dicarboxylic acid is taken from the group consisting of phthalic acid, isophthalic acid, terphthalic acid, and naphthalene dicarboxylic acid.

10. The composition of claim 9 wherein said monohydroxy polyalkylene ether has the formula

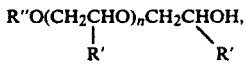

where n is an integer from 1 to 100, R″ is an aromatic or aliphatic hydrocarbon having from 1 to 100 carbon atoms, and R′ is hydrogen or an aromatic or aliphatic hydrocarbon having from 1 to 100 carbon atoms.

11. The composition according to claim 10 wherein said ether is derived from polyethylene oxide, polypropylene oxide or polybutylene oxide.

12. The composition of claim 9 wherein said polyalkylene amine is selected from polyethylene amines, polypropylene amines and polybutylene amines.

13. The composition according to claim 12 wherein said polyethylene amines comprise diethylene triamine, tetraethylene pentamine, triethylene tetramine, and pentaethylene hexamine.

14. The composition of claim 9 wherein said succinimide has the structure

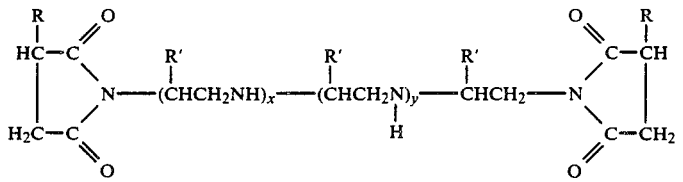

wherein x and y are integers, y is at least 1, x+y is from 1 to 10; and where R is an alkyl or alkenyl group containing from 8 to about 10,000 carbon atoms, and R′ is H or $C_1$ to $C_6$ alkyl.

15. The composition of claim 9 wherein said succinimide is the reaction product of about one molar equivalent of polyisobutenyl succinic anhydride containing from 8 to 10,000 carbon atoms and about one-half molar equivalent of tetraethylene pentamine; and said monocarboxylic acid residue comprises the reaction product, under esterification conditions, of about equimolar equivalents of phthalic anhydride and polybutylene ether.

* * * * *

UNITED STATES PATENT AND TRADEMARK OFFICE

CERTIFICATE OF CORRECTION

PATENT NO. : 5,069,684

DATED : December 3, 1991

INVENTOR(S) : Blain, et al

It is certified that error appears in the above-identified patent and that said Letters Patent is hereby corrected as shown below:

Column 9, line 51, two occurrences of "CH–O" should be --CHO--.
line 63, "were" should read --where--.

Signed and Sealed this

Twenty-seventh Day of April, 1993

*Attest:*

MICHAEL K. KIRK

*Attesting Officer*

*Acting Commissioner of Patents and Trademarks*